United States Patent [19]

Henriksson

[11] 4,349,075

[45] Sep. 14, 1982

[54] HYDRAULICALLY OPERATED IMPACT MOTOR

[75] Inventor: Stig R. Henriksson, Nacka, Sweden

[73] Assignee: Atlas Copco Aktiebolag, Nacka, Sweden

[21] Appl. No.: 85,409

[22] Filed: Oct. 17, 1979

[30] Foreign Application Priority Data

Oct. 19, 1978 [SE] Sweden ..... 7810882

[51] Int. Cl.[3] ..... B25D 9/04; B25D 9/12; F01L 25/04

[52] U.S. Cl. ..... 173/134; 91/300; 91/321; 91/441; 173/DIG. 4

[58] Field of Search ..... 91/300, 321, 441; 173/134, DIG. 4

[56] References Cited

U.S. PATENT DOCUMENTS

| | | | |
|---|---|---|---|
| 3,033,168 | 5/1962 | Ruhl | 91/441 |
| 3,207,043 | 9/1965 | Kay | 91/321 X |
| 3,322,038 | 5/1967 | Dobson | 91/300 X |
| 3,552,269 | 1/1971 | Arndt | 91/291 X |
| 3,741,072 | 6/1973 | Romell et al. | 91/290 |
| 3,771,422 | 11/1973 | Kamman | 91/441 X |
| 3,780,621 | 12/1973 | Romell | 91/290 |
| 3,939,757 | 2/1976 | Jablonsky | 91/441 X |
| 4,073,350 | 2/1978 | Eklöff et al. | 173/134 X |
| 4,172,411 | 10/1979 | Matsuda et al. | 91/300 X |

FOREIGN PATENT DOCUMENTS

| | | | |
|---|---|---|---|
| 1300329 | 7/1969 | Fed. Rep. of Germany | 91/321 |
| 2502215 | 4/1976 | Fed. Rep. of Germany | 173/134 |

*Primary Examiner*—W. Carter Reynolds
*Attorney, Agent, or Firm*—Frishauf, Holtz, Goodman and Woodward

[57] ABSTRACT

A hydraulically operated impact motor, e.g. for a jack hammer, has a hammer piston that has a piston surface 19 in a pressure chamber 21 which is constantly pressurized in order to effect the work strokes of the hammer piston, and a larger piston surface 20 in a second pressure chamber 21 which is intermittently pressurized in order to effect the return strokes of the hammer piston. The second pressure chamber 22 is also connected to the exhaust line via a one-way valve that permits flow towards the second pressure chamber 22.

22 Claims, 6 Drawing Figures

HYDRAULICALLY OPERATED IMPACT MOTOR

BACKGROUND OF THE INVENTION

This invention relates to an improved hydraulically operated impact motor.

Most known hydraulically operated impact motors have hammer pistons which have two lands with a valve portion between the lands in order to obtain reliable valving functions. Such a prior system is shown in U.S. Pat. No. 3,780,621 in which two valve control lines are provided, both of which are alternately pressurized and relieved of pressure. One-land hammer pistons are known from U.S. Pat. No. 3,552,269 and British Pat. No. 1,436,079. Both of these prior one-land constructions are complicated and are thus not very reliable. The valve in U.S. Pat. No. 3,552,269 operates on restrictions which make it slow. In British Pat. No. 1,436,079 these are two valves which make the valving action slow.

The object of the present invention is to provide an improved and highly efficient hydraulic impact motor in which the construction is simple, and the valve is fast acting and very reliable.

SUMMARY OF THE INVENTION

According to the present invention, a hydraulically operated impact motor comprises a cylinder, a hammer piston which is reciprocably mounted in said cylinder and arranged to impact upon an anvil means, a first piston surface of said hammer piston located in a first pressure chamber to effect the working stroke of the hammer piston, a second piston surface of said hammer piston located in a second pressure chamber to effect the return stroke of the hammer piston, and a valve coupled to connect at least said second pressure chamber alternatively to an inlet of high-pressure hydraulic motive fluid and to an outlet. According to the present invention, said second pressure chamber is connected also to a source of low pressure hydraulic fluid via a one-way valve that permits flow in the direction towards the pressure chamber.

As a result, the efficiency increases considerably—probably because the rebounce energy of the piston is utilized. Another advantage is that the changeover of the valve when the hammer piston is close to its impact position becomes less critical.

The hammer piston of the present invention preferably has only a single land. A one-land hammer piston is advantageous since there is only a small leakage past the land relative to the leakage past two lands. However, in the one-land piston of the present invention, there is no leakage during the return stroke since there is the same pressure on both sides of the land when the hammer piston moves rearwardly.

DETAILED DESCRIPTION

Figure 1:
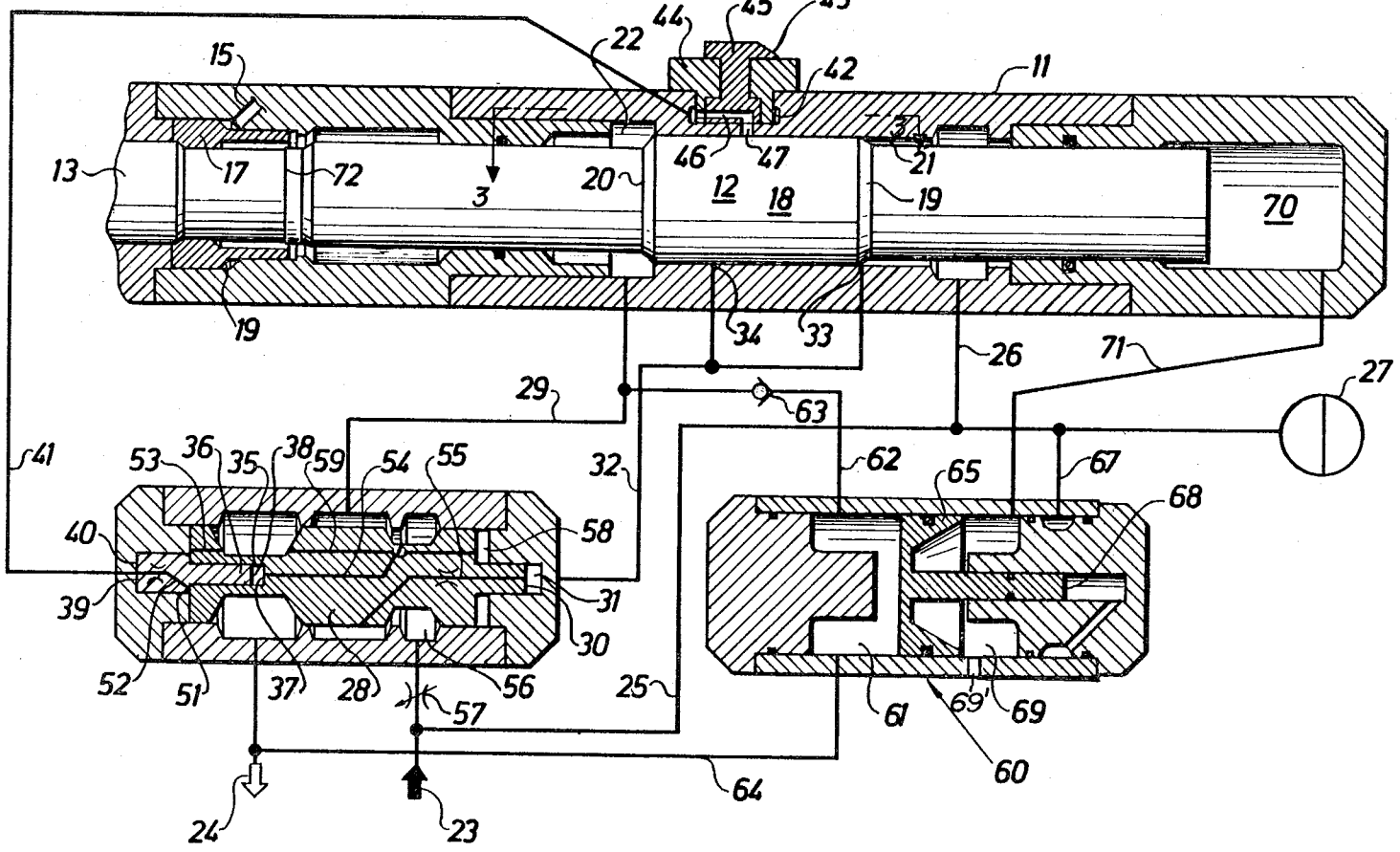
FIG. 1 is a schematic longitudinal section through a hydraulic impact motor in a form of a jack hammer, the front portion of the impact motor being cut away.
Figure 2:
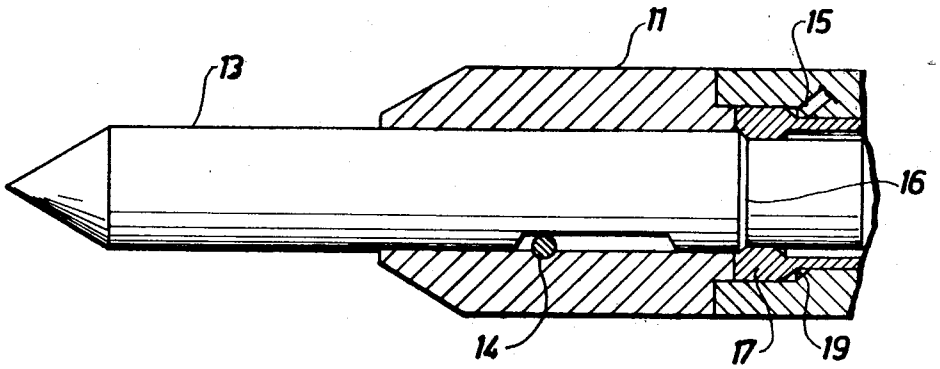
FIG. 2 shows in a longitudinal section the front position of the jack hammer shown in FIG. 1.

The impact motor shown in the figures comprises a housing 11 that forms a cylinder in which a hammer piston 12 is slidable (FIG. 1). A tool in the form of a chisel 13 is insertable into the front end of the housing and it is prevented from falling out by means of a chisel holder 14 (FIG. 2). The chisel takes support rearwardly with a shoulder 16 against an annular support piston 17 that resiliently supports the chisel 13 in the housing 11. The support piston 17 is axially slideable in the housing 11 and forced forwardly towards its illustrated position in the housing by the pump pressure that is transmitted through a conduit 15 to an annular piston surface 19 on the support piston 17. The support piston 17 is forced forwardly by a force that is greater than the feed force that is normally transmitted to the housing during operation so that the support piston 17 will define the impact position of the chisel as shown in FIGS. 1 and 2. The jack hammer can be a hand-held jack hammer in which the feed force is manually applied or it can be mounted for example on a back-hoe. The impact motor can also be used in a rock drill.

The hammer piston 12 has a head in the form of an annular land 18 with two annular piston surfaces 19, 20. The rear piston surface 19 makes a movable wall to a rear pressure chamber 21 that is formed in the cylinder 11 (the housing) and the front piston surface 20 a movable wall of a front pressure chamber 22 that is formed in the cylinder. The front piston surface 20 is larger than the rear piston surface 19.

The impact motor has a main inlet 23 and a main outlet 24 for the hydraulic fluid, e.g. hydraulic oil, and when the main inlet 23 is pressurized, the rear pressure chamber 21 is permanently pressurized through a conduit 25, 26. A gas pressure accumulator 27 is connected to the rear pressure chamber 21. A valve in the form of a spool 28 is arranged to alternatively pressurize and exhaust the front pressure chamber 22 via a connection conduit 29.

Figure 3:
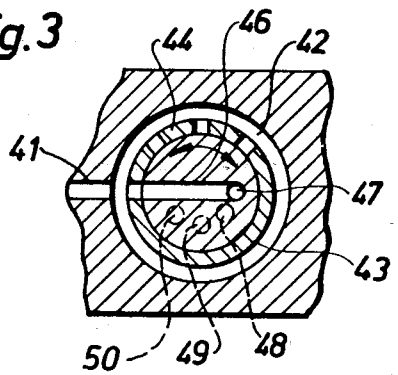
FIG. 3 is a section taken along line 3—3 in FIG. 1.

The valve 28 has a cylindrical end face 30 located in a cylindrical control chamber 31. A conduit 32 leads between the control chamber 31 and the main cylinder 11. The conduit 32 is branched so that it has two ports 33, 34 to the cylinder 11. The other end of the valve 28 has a cylindrical bore 35 that forms a control chamber into which a control piston 36 protrudes. The bore 35 and the control piston 36 have end faces 37, 38 that are smaller than the end face 30 at the other end of the valve. The control piston 36 has its other and larger end face 39 located in a control chamber 40 that, by means of a control conduit 41, is connected to an annular chamber 42 of a device 43 for adjusting the stroke length of hammer piston 12. The end face 39 of the control piston is larger than the end face 30 of the valve. The device 43 comprises an annular bush 44 that is fixed to the housing 11. Inside the bush 44, there is a manually turnable cock 45. Cock 45 has a passage 46 that selectively connects the annular chamber 42 and thereby the control chamber 40 to any one of four ports 47–50 (FIG. 3) into the cylinder bore. In the Figures, port 47 is coupled to the control conduit 41.

A restricted passage 52 leads between the control chamber 40 and an intermediate chamber 51 which is always connected to exhaust through a larger passage 53. The bore or control chamber 35 is always connected to the inlet via a passage 54 whereas the control chamber 31 at the other end of the valve is always connected to the connection conduit 29 by means of a restricted passage 55. An intermediate chamber 58 is always connected to the exhaust through a passage 59. Between the main inlet 23 and an annular inlet chamber 56 of the valve there is a variable restriction 57. Passage 54 and inlet chamber 56 constantly subject the third piston 38 to pressure.

An accumulator 60 has an accumulator chamber 61 that is continuously connected to the connection conduit 29 via a conduit 62 that contains a one-way valve 63 that permits flow only in the direction from the accumulator chamber 61 to the connection conduit 29, that is, only in the direction from the accumulator chamber 61 to the front pressure chamber 22 of housing 11. The accumulator chamber 61 is also continuously connected to the main outlet 24 through a passage 64. A piston 65 forms a movable wall of the accumulator chamber 61. The piston 65 is preloaded by the pressure in the rear pressure chamber 21 transmitted through a conduit 67 to act on the end face 68 of a piston rod 80 of the piston 65. Thus, the piston rod 80 is itself a piston. An intermediate chamber 69 in the accumulator is connected to an end chamber 70 in the cylinder 11 at the rear of the hammer piston 12 by means of a conduit 71. The intermediate chamber 69 and the end chamber 70 are filled with air of atmospheric pressure or with air or other gas of slightly higher pressure. They are provided with non-illustrated drain conduits for leading away hydraulic oil that leaks into the chambers 69, 70. Chamber 69 has a small drain hole 69' to the atmosphere.

In the Figures, the valve 28 and the accumulators 27, 60 are shown outside of the housing 11 although they are in fact located in the housing 11 and the conduits shown in the Figures are conveniently channels in the housing 11. The drawings are schematic and it should be noted that the hammer piston 12, the valve 28 and the accumulators 27, 60 are not drawn to the same scale. This fact will however not be harmful to the understanding of the operation of the apparatus.

Figure 4:
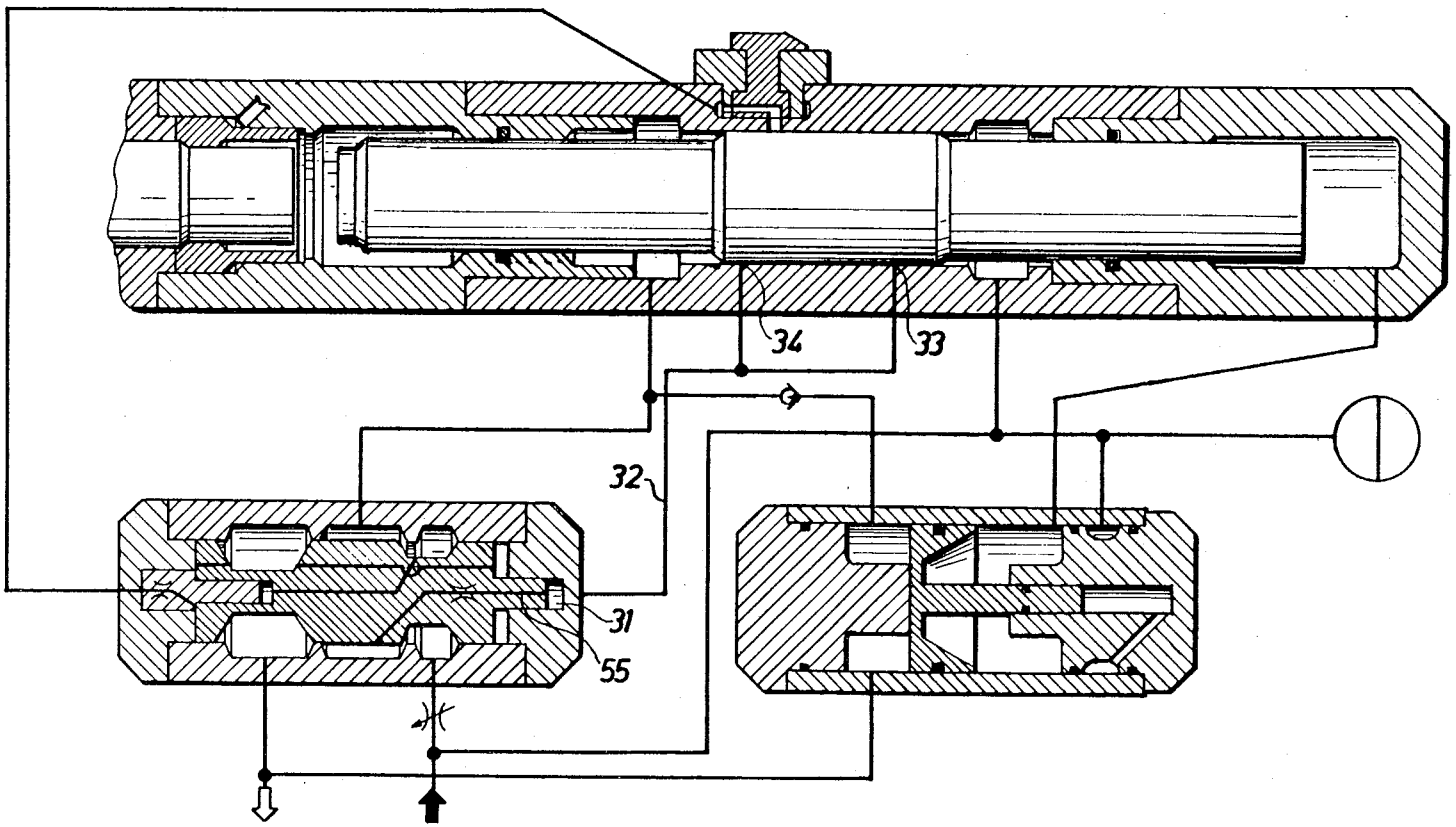
FIGS. 4–6 are longitudinal sections corresponding to FIG. 1 but showing some details of the impact motor in other relative positions.
Figure 5:
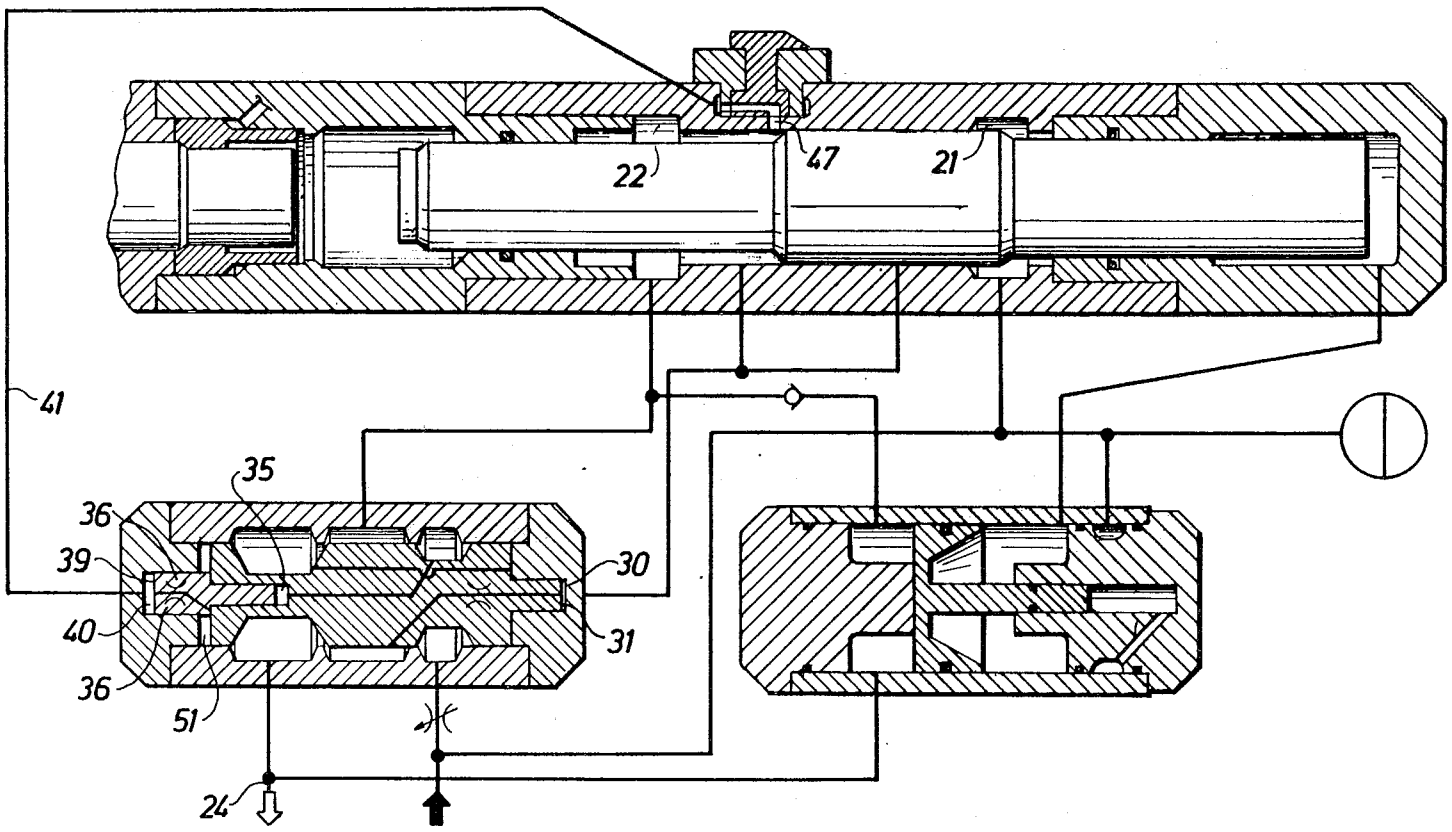
Figure 6:
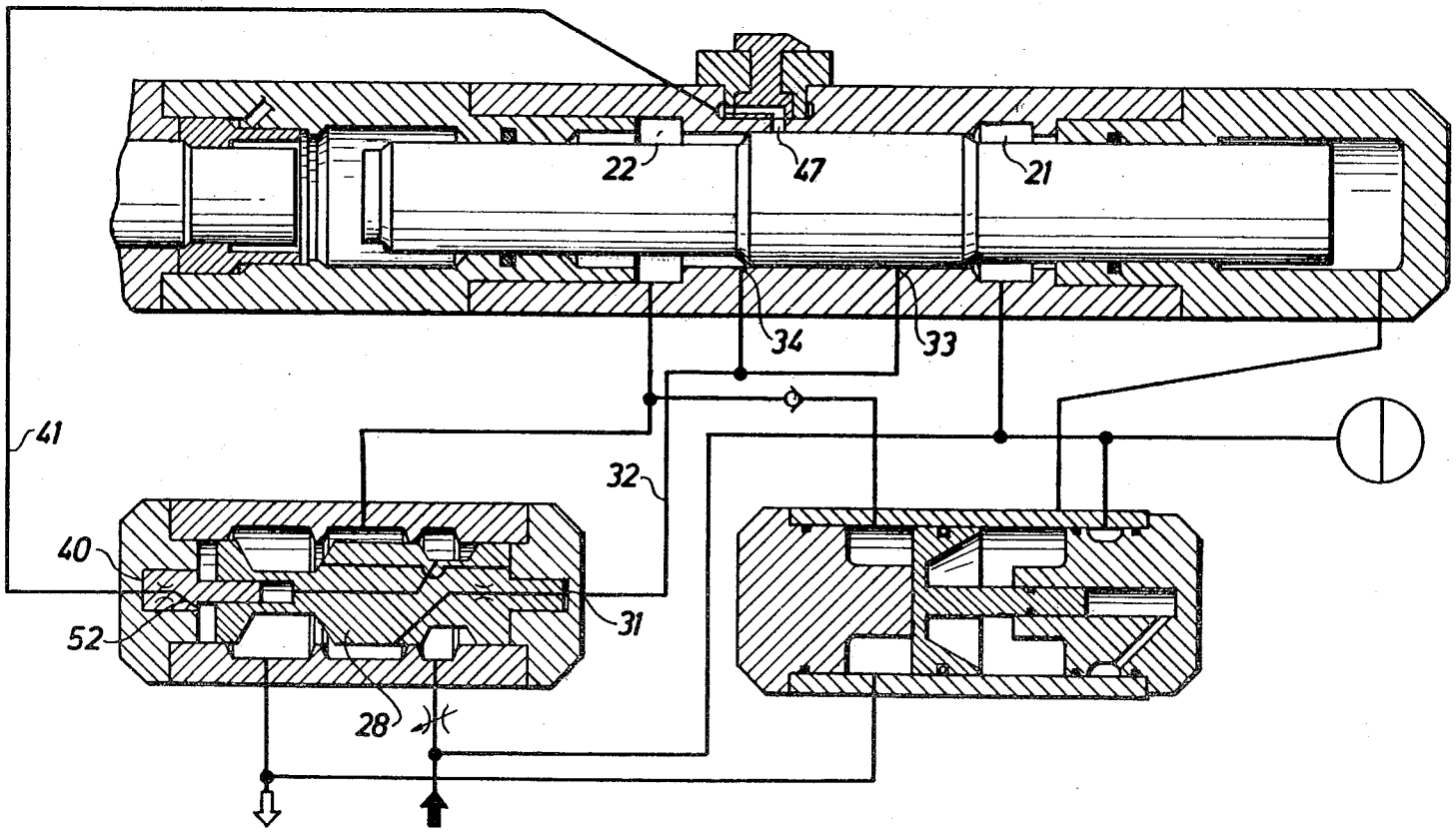

The operation of the impact motor will now be described. Assume that the hammer piston 12 during operation just impacts on the anvil surface 72 of the chisel 13 as shown in FIG. 1 and that the valve 28 has just changed over to its position shown in FIG. 1 in which it pressurizes the front pressure chamber 22 via the connection conduit 29. The valve 28 is in its illustrated position because of the pressure in the conduit chamber 31, and the control piston 36 is in its illustrated position because the control passage 41 is shut off (the port 47 is blocked by the land 18 of the hammer piston). Oil that leaks into the control chamber 40 is drained off through the passage 52. During a portion of its return movement, the hammer piston 12 will cover both ports 33, 34 of the control passage 32 as shown in FIG. 4, but during this period the pressure in the control chamber 31 is maintained by the leak pressure 55 in the valve 28. It will not affect that the port 34 is opened to pressure chamber 22 during the return stroke, since the pressure chamber 22 is then under pressure. When the hammer piston 12 reaches its position shown in FIG. 5 and opens the port 47, the control conduit 41 and the control chamber 40 are pressurized from the front pressure chamber 22 so that the control piston 36 shifts the valve 28 into the position of FIG. 5. (The piston surface 39 is larger than the piston surface 30.) The front pressure chamber 22 is now connected to the outlet 24 and the control piston 36 will therefore return to its previous position as shown in FIG. 6 whereas the valve 28 remains in its position of FIG. 5 because of the pressure in the control chamber 35. The pressure chamber 30 is relieved of pressure since the port 34 is open to the front pressure chamber 22 which is now connected to the outlet 24.

The hammer piston will now retard and turn because of the continuous pressure in the rear pressure chamber 21. During the work-stroke shown in FIG. 6, the land 18 of the hammer piston 12 will again cover the port 34, but the valve 28 will remain stably in its position because oil that leaks into the control chamber 31 is conveyed through the passage 55 without increasing the pressure in the control chamber 31. If oil leaks into the control passage 41 when the port 47 is blocked it is drained off continuously through the passage 52.

Just prior to impact the land 18 of the hammer piston opens the port 33 to the rear pressure chamber 21 so that the control chamber 31 is pressurized and the valve 28 changes over to its position shown in FIG. 1 in which it pressurizes the front pressure chamber 22.

During the work-stroke of the hammer piston 12, hydraulic oil is forced out from the front pressure chamber 22 and into the main outlet 24. Because of the large flow, some of the oil is accumulated in the accumulator chamber 61 at a somewhat increased pressure.

When the hammer piston 12 impacts on the chisel 13, a shock wave is induced in the chisel and it propagates forwardly through the chisel. If the end of the chisel does not protrude fully into the material being worked because the material is too hard, part of the shock wave will reflect at the chisel end and move back upwardly through the chisel and reach the hammer piston 12 so that the hammer piston bounces back from the chisel. Because of this rebound, the hammer piston can have such a big instantaneous acceleration that the valve 28 cannot supply enough oil to the front pressure chamber 22. The pressure in the front pressure chamber 22 can therefore instantaneously be low. If the pressure in the pressure chamber 22 becomes lower than the pressure in the accumulating chamber 61 of the accumulator 60, oil will be forced through the passage 62 and the one-way valve 63 into the front pressure chamber 22. At least part of the rebound energy of the hammer piston will then be returned to the high pressure accumulator 27. The adjustable restriction 57 can therefore be used to restrict the supply to the valve 28 without affecting the impact energy per blow. Thus, by reducing the inflow to the valve 28 by means of the restriction 57, the impact rate is reduced and the total output is also reduced, but the impact energy per blow remains substantially constant. The impact motor can therefore be connected to low output pumps and still operate with full energy impacts. The impact rate with a fully open restriction 57 is basically determined by the difference between area 20 and area 19 which is the effective area for effecting the return strokes. For a jack hammer, this effective area can suitably be about 10% of area 19 which makes the return strokes slow. For a rock drill, this effective area can instead be about 50% of area 19, so that a suitable higher impact rate is achieved.

A one-way valve can be inserted into the conduit 26 to permit flow only in the direction towards the rear pressure chamber 21. Such a one-way valve makes the accumulator 27 work as a spring above the pump pressure, and the characteristic curve of the accumulator—that is, the curve defining the pressure as a function of the accumulated volume—can be chosen more steep than when the accumulator must work at the pump pressure all the time.

I claim:

1. Hydraulically operated impact motor comprising:
a source (23) of high-pressure hydraulic motive fluids;
a cylinder (11);
a hammer piston (12) reciprocably mounted in said cylinder (11) and arranged to impact upon an anvil means (13), said hammer piston (12) defining with said cylinder (11) first and second pressure chambers (21, 22, respectively);
said hammer piston (12) having a first piston surface (19) located in said first pressure chamber (21) to effect the working stroke of said hammer piston, and a second piston surface (20) located in said second pressure chamber (22) to effect the return stroke of said hammer piston;
a valve (28) coupled to connect at least said second pressure chamber (22) alternatively to said source (23) of high-pressure hydraulic motive fluid and to a motive fluid outlet (24);
a source (60) of low pressure hydraulic fluid; and
a one-way valve (63) coupling said low pressure source (60) to said second pressure chamber (22) at least when the hammer piston (12) is close to its impact position for permitting flow of low pressure hydraulic fluid only in the direction towards said second pressure chamber (22).

2. The impact motor of claim 1, wherein said source (60) of low pressure hydraulic fluid comprises an exhaust line (64) from said valve (28).

3. The impact motor of claim 2, wherein said low pressure source comprises an accumulator (60) having an accumulator chamber (61) coupled to said exhaust line (64).

4. The impact motor of claim 3, wherein said source (23) of high pressure motive fluid is coupled to said accumulator (60); and said accumulator (60) further comprises an accumulator piston (65) and a further piston (68) having a smaller area than said accumulator piston (65), said accumulator piston being pre-loaded by said further piston (68), said further piston (68) being loaded by said high-pressure motive fluid.

5. The impact motor of claim 4, wherein said accumulator (60) comprises a housing in which said accumulator chamber is located; and said accumulator piston (65) and said further piston (68) and integrally formed, and are slideably mounted in said accumulator housing, said accumulator chamber (61) being located on one side of said accumulator piston, said further piston (68) extending from the side to said accumulator piston (65) which is remote from said accumulator chamber (61), said further piston slideably extending into a further chamber defined in said accumulator housing, said further chamber of said accumulator being coupled to said source (23) of high pressure motive fluid.

6. The impact motor of claim 1, wherein said source (23) of high pressure motive fluid is coupled to an inlet passage leading to said valve (28), and further comprising a variable restriction (57) in said inlet passage to said valve (28) for adjusting the rate of impact of said hammer piston upon said anvil.

7. The impact motor of claim 3, comprising a conduit (62) leading directly from said accumulator chamber (61) of said accumulator (60) to said second pressure chamber (22); said one-way valve (63) being located in said conduit (62).

8. The impact motor of claim 1, wherein said hammer piston (12) comprises an annular land (18); and wherein said first and second piston surfaces (19, 20) of the hammer piston are the rear and front surfaces of said annular land (18) of the hammer piston.

9. The impact motor of claim 1, wherein, in use, said first pressure chamber (21) is permanently pressurized.

10. The impact motor of claim 1, further comprising a housing defining said cylinder (11); and a support element (17) for resiliently supporting a work tool (13) in said housing (11), said work tool comprising said anvil means.

11. Hydraulically operated impact motor comprising:
a source (23) of high-pressure hydraulic motive fluid;
a cylinder (11) having first and second port means (33, 34; 47) leading into said cylinder;
a hammer piston (12) reciprocably mounted in said cylinder (11) and arranged to impact upon an anvil means (72),
said hammer piston (12) defining with said cylinder (11) first and second pressure chambers (21, 22, respectively), said first and second pressure chambers (21, 22) being in selective communication with said first and second port means;
a single piston land (18) on said hammer piston (12);
a first piston surface (19) on said land and located in said first pressure chamber (21) to effect a stroke of said hammer piston (12) in one direction;
means (25, 26) coupled to said first pressure chamber (21) for constantly pressurizing said first pressure chamber (21) in use;
a second piston surface (20) on said land and located in said second pressure chamber (22) to effect a stroke of said hammer piston in the other direction;
a valve (28) coupled to connect at least said second pressure chamber (22) alternatively to said source (23) of high-pressure hydraulic motive fluid (23) and to a motive fluid outlet (24);
said valve (28) comprising:
means defining a valve cylinder;
a valving element (28) axially movable in said valve cylinder;
a first piston means (30, 31) on said valving element (28) for forcing said valving element (28) into a first position when subject to pressure;
a first control passage (32) leading between said first piston means and said first port means (33, 34) which leads into said cylinder (11);
a second piston means (36, 39) for forcing said valving element (28) into a second position when subject to pressure, said second piston means (36, 39) being movable away from said valving element (28);
a second control passage (41) leading between said second port means (47) which leads into said cylinder and said second piston means (36, 39);
a third piston means (38) for moving said second piston means (36, 39) away from said valving element (28) when said second piston means (36, 39) is relieved of pressure;
means (54, 56) coupled to said third piston means (38) for constantly subjecting said third piston means to pressure;
said piston land (18) being arranged to selectively block said first and second port means (33, 34; and 47, respectively) in response to its axial position in the cylinder.

12. The impact motor of claim 11 wherein said one direction is the direction of delivering impact of said anvil means (72) by said hammer piston (12).

13. The impact motor of claim 11 wherein said third piston means (38) has a piston area that is smaller than the piston area of said first piston means (30).

14. The impact motor of claim 11 or 13 wherein said first piston means (30) has a piston area that is smaller than the piston area of said second piston means (39).

15. The impact motor of claim 11 wherein said single piston land (18) is arranged to alternately open said first port means (33, 34) to said first and second pressure chambers (21, 22, respectively) and to block said first port means (33, 34) with an interval therebetween, and said single piston land (18) is further arranged to alternatively open said second port means (47) to said second pressure chamber (22) and to block said second port means (33, 34).

16. The impact motor of claim 13 wherein said first port means (33, 34) includes an opening (33) leading into said first pressure chamber (21) and an opening (34) leading into said second pressure chamber (22); and said second port means (47) is located within axial limits defined by said two openings (33, 34) and extends axially a distance that is substantially smaller than the distance between said openings (33, 34).

17. The impact motor of claim 16 wherein the distance between said first and second piston surfaces (19, 20) of said single land (18) is larger than the distance between said openings of said first port means (33, 34).

18. The impact motor of claim 16 wherein said first port means comprises two separate ports (33, 34) in said cylinder (11) at an axial distance from each other; and said second port means (47) comprises a plurality of ports that are selectively connectable to said second control passage (41).

19. The impact motor of claim 11 wherein said first port means comprises two separate ports (33, 34) in said cylinder (11) at an axial distance from each other.

20. The impact motor of claim 19 wherein said second port means (47) comprises a plurality of ports that are selectively connectable to said second control passage (41).

21. The impact motor of claim 11 wherein said means (55, 56) for constantly pressurizing said first pressure chamber (21) and said means for constantly pressurizing said third piston means (38) are coupled to said source (23) of high pressure motive fluid.

22. The impact motor of claim 11, wherein said source (23) of high pressure motive fluid is coupled to an inlet passage leading to said valve (28), and further comprising a variable restriction (57) in said inlet passage to said valve (28) for adjusting the rate of impact of said hammer piston upon said anvil.

* * * * *